US005105499A

United States Patent [19]

Dirksing

[11] Patent Number: 5,105,499

[45] Date of Patent: Apr. 21, 1992

[54] TOOTHBRUSH HAVING HANDLE JOINED TO BRUSH HEAD BY NON-PINCHING FLEXIBLE TWIN BEAM STRUCTURE

[75] Inventor: Robert S. Dirksing, Cincinnati, Ohio

[73] Assignee: The Procter & Gamble Company, Cincinnati, Ohio

[21] Appl. No.: 662,852

[22] Filed: Mar. 1, 1991

[51] Int. Cl.[5] ..... A46B 5/06

[52] U.S. Cl. ..... 15/167.1; 15/143 R; 15/172

[58] Field of Search ..... 15/167.1, 167.2, 172, 15/143 R

[56] References Cited

U.S. PATENT DOCUMENTS

| | | | |
|---|---|---|---|
| Re. 22,938 | 11/1947 | Kisky | 15/167 |
| D. 85,112 | 9/1931 | McGauley | 15/167.1 |
| 759,490 | 5/1904 | Yates . | |
| 1,131,863 | 3/1915 | Phillips . | |
| 1,132,326 | 3/1915 | Fouyer | 15/167.1 |
| 1,327,807 | 1/1920 | Burleigh . | |
| 1,471,626 | 10/1923 | Pachmayr . | |
| 1,722,131 | 7/1929 | Fitzgerald | 15/167.1 |
| 1,796,001 | 3/1931 | Church . | |
| 1,850,810 | 3/1932 | Schwerin . | |
| 1,914,240 | 6/1933 | Caldwell | 15/167.1 |
| 1,928,328 | 9/1933 | Carpentier | 15/167 |
| 2,083,217 | 6/1937 | Brothers et al. | 15/167 |
| 2,114,947 | 4/1938 | Warsaw | 15/167 |
| 2,139,094 | 12/1938 | Opolo | 74/523 |
| 2,219,753 | 10/1940 | Seguin | 15/188 |
| 2,224,788 | 12/1940 | Jobst | 15/167 |
| 2,254,365 | 9/1941 | Griffith et al. | 15/172 |
| 2,273,207 | 2/1942 | Kuhn | 15/167.1 |
| 2,445,657 | 7/1948 | Bennett | 15/167 |
| 2,517,045 | 8/1950 | Soule | 15/176 |

(List continued on next page.)

FOREIGN PATENT DOCUMENTS

| | | | |
|---|---|---|---|
| 260612 | 10/1912 | Fed. Rep. of Germany . | |
| 283892 | 4/1915 | Fed. Rep. of Germany . | |
| 554155 | 7/1932 | Fed. Rep. of Germany . | |
| 155730 | 9/1932 | Fed. Rep. of Germany . | |
| 2402785 | 3/1979 | Fed. Rep. of Germany . | |
| 3414623 | 10/1985 | Fed. Rep. of Germany . | |
| 8622144.2 | 7/1987 | Fed. Rep. of Germany . | |
| 3612108 | 10/1987 | Fed. Rep. of Germany . | |
| WO88/06417 | 9/1988 | Fed. Rep. of Germany . | |
| 3805326 | 9/1988 | Fed. Rep. of Germany . | |
| 3840136.3 | 11/1988 | Fed. Rep. of Germany . | |
| 8903911.4 | 6/1989 | Fed. Rep. of Germany . | |
| 552210 | 11/1925 | France . | |
| 599790 | 1/1926 | France . | |
| 606938 | 6/1926 | France . | |
| 910591 | 6/1946 | France . | |
| 1247433 | 10/1960 | France . | |
| 1542567 | 10/1968 | France . | |
| 2053885 | 4/1971 | France . | |
| 485723 | 10/1953 | Italy . | |
| 8801480 | 3/1988 | PCT Int'l Appl. | 15/167.1 |
| 77944 | 9/1949 | Switzerland . | |
| 202424 | 8/1923 | United Kingdom | 15/144 R |
| 216355 | 5/1924 | United Kingdom | 15/176.1 |
| 476479 | 12/1937 | United Kingdom . | |
| 1005334 | 9/1965 | United Kingdom . | |
| 1164597 | 9/1969 | United Kingdom . | |
| 2081570 | 2/1982 | United Kingdom . | |

OTHER PUBLICATIONS

Price list for Celluloid Brush Products, Gold Medal International Hygiene Exhibition Dresden 1911, supplement to the main catalog, Jos. Ed. Faller Brush Manufacturer Todtnau (Baden).

Co-pending commonly assigned U.S. patent application (List continued on next page.)

*Primary Examiner*—Edward L. Roberts
*Assistant Examiner*—Terrence R. Till
*Attorney, Agent, or Firm*—E. Kelly Linman; Richard C. Witte; Thomas H. O'Flaherty

[57] ABSTRACT

A toothbrush employing a non-pinching resilient twin beam structure to connect the brush handle to the brush head, the twin beam structure having one beam which is wider in cross-sectional width than the other beam in order to prevent soft oral tissue from entering the opening formed between the beams and being pinched between by the interior surfaces of the beams during deformation of the twin beam structure.

8 Claims, 3 Drawing Sheets

U.S. PATENT DOCUMENTS

| | | | |
|---|---|---|---|
| 2,631,320 | 3/1953 | Bressler | 15/167 |
| 2,660,745 | 12/1953 | Yusko | 15/22 |
| 2,706,825 | 4/1955 | Blakeman | 15/167.1 |
| 2,864,111 | 12/1958 | Rotceig | 15/167.1 |
| 3,193,864 | 7/1965 | Makowsky | 15/172 |
| 3,609,789 | 10/1971 | Slater | 15/167.1 |
| 3,691,587 | 9/1972 | Makowsky | 15/167 R |
| 3,994,038 | 11/1976 | Moulet | 15/167 R |
| 4,253,212 | 3/1981 | Fujita | 15/167 R |
| 4,356,585 | 11/1982 | Protell et al. | 15/111 |
| 4,461,053 | 7/1984 | Nitzsche et al. | 15/172 |
| 4,476,604 | 10/1984 | White et al. | 15/105 |
| 4,520,526 | 6/1985 | Peters | 15/167 R |
| 4,654,922 | 4/1987 | Chen | 15/172 |
| 4,667,360 | 5/1987 | Marthaler et al. | 15/167 R |
| 4,680,825 | 7/1987 | White et al. | 15/105 |
| 4,691,404 | 9/1987 | Tarrson et al. | 15/167 R |
| 4,691,405 | 9/1987 | Reed | 15/201 |
| 4,829,621 | 5/1989 | Phenegar | 15/172 |
| 4,864,676 | 9/1989 | Schaiper | 15/167.1 |
| 4,942,894 | 7/1990 | Lai | 132/323 |

OTHER PUBLICATIONS of R. S. Dirksing, Ser. No. 663,214 filed Mar. 1, 1991 entitled "Toothbursh Employing Resiliently Buckling Arch to Indicate Excessive Brushing Pressure".

Co-pending commonly assigned U.S. patent application of R. Kirberger, Ser. No. 446,962 filed Dec. 6, 1989 entitled "Toothbrush".

Co-pending commonly assigned U.S. patent application of R. Kirberger, Ser. No. 429,741 filed Oct. 31, 1989 entitled "Toothbrush".

Co-pending commonly assigned U.S. patent application of K. Bartsch, Ser. No. 440,822 filed Nov. 22, 1989 entitled "Toothbrush with a Deflecting Part Having a Deflection Profile".

TOOTHBRUSH HAVING HANDLE JOINED TO BRUSH HEAD BY NON-PINCHING FLEXIBLE TWIN BEAM STRUCTURE

TECHNICAL FIELD

This invention relates to an improved toothbrush having a resiliently flexible twin beam structures joining the handle to the brush head to either indicate or to help prevent the application of excessive brushing force to the user's teeth and gums. In particular, this invention relates to such an improved toothbrush wherein the pinching of soft oral tissue between the individual beams comprising the twin beam structure during brushing.

BACKGROUND OF THE INVENTION

One prior art toothbrush exhibiting a resiliently flexible joint between the brush head and the handle is disclosed in U.S. Pat. No. 4,520,526 issued to Peters on June 4, 1985. The disclosed means for providing the flexible joint in the Peters patent comprises either: (1) removing part of the material from the top portion and part of the material from the bottom portion of the handle to form an area of reduced cross-section; or (2) forming a hollow in the handle which extends horizontally in the area connecting the handle to the brush head. The horizontally extending hollow forms a thin flexible top member and a thin flexible bottom member which, for the purpose of the present application, are hereinafter referred to as beams. Application of force to the handle of the Peters toothbrush by the user during brushing results in bending of the flexible members or beams in direct response to the applied force, thereby further limiting the amount of brushing force which can be applied to the user's teeth and gums as the deflection of the brush head increases, at least until such time as the innermost surfaces of the flexible beams contact one another. However, a serious problem posed by the aforementioned Peters toothbrush is that soft oral tissue can be pinched between the flexible members, particularly as the top member bends and moves closer toward the lower member.

Commonly assigned, concurrently, filed U.S. patent application Ser. No. 663,214 filed Mar. 1, 1991 in the name of Robert S. Dirksing and entitled TOOTHBRUSH EMPLOYING RESILIENTLY BUCKLING ARCH TO INDICATE EXCESSIVE BRUSHING PRESSURE, the disclosure of which is hereby incorporated herein by reference, discloses a toothbrush employing an improved resiliently deformable twin beam structure which functions not as a force limiting device, as in the case of the aforementioned Peters toothbrush, but as an excessive brushing force indicator. Unlike the toothbrush of Peters, the twin beam structure disclosed in the commonly assigned concurrently filed U.S. Patent Application of Robert S. Dirksing comprises an upwardly convex back side beam which substantially prevents deformation of the brush head relative to the brush handle until a predetermined brushing force is exceeded, at which time the upwardly convex beam undergoes resilient deformation and abruptly buckles. The abrupt buckling of the back side beam in the twin beam structure may also cause pinching of soft oral tissue which enters the gap between the individual beams. Although it is not intended that the user continue brushing with the latter toothbrush in its buckled condition, continued brushing with the twin beam structure in its buckled condition can also produce pinching of soft oral tissue in the wedge shaped openings which are formed near the contact point between the innermost surfaces of the beams.

Thus, while the forgoing toothbrushes behave quite differently in use, they both exhibit a similar problem in use, namely pinching of the user's soft oral tissue during the brushing process.

OBJECTS OF THE INVENTION

Accordingly, it is an object of this invention to provide a toothbrush employing a flexible portion comprising either a hollow of the type disclosed in the aforementioned Peters Patent or a twin beam structure of the type disclosed in the aforementioned commonly assigned, concurrently filed U.S. Patent Application of Robert S. Dirksing, but which eliminates or at least minimizes pinching of the user's soft oral tissue during brushing.

DISCLOSURE OF THE INVENTION

The present invention comprises a toothbrush employing a resilient twin beam structure to connect the brush handle to the brush head, on a beam being wider in cross-sectional width than the other to prevent soft oral tissue from entering the opening between the twin beams and being pinched by the interior surfaces of the twin beams during deformation of the twin beam structure.

BRIEF DESCRIPTION OF THE DRAWINGS

While the specification concludes with claims that particularly point out and distinctly claim the subject matter regarded as forming the present invention, it is believed that the present invention will be better understood from the following detailed description with reference to the drawings in which:

DETAILED DESCRIPTION OF THE PREFERRED EMBODIMENTS

Figure 1:
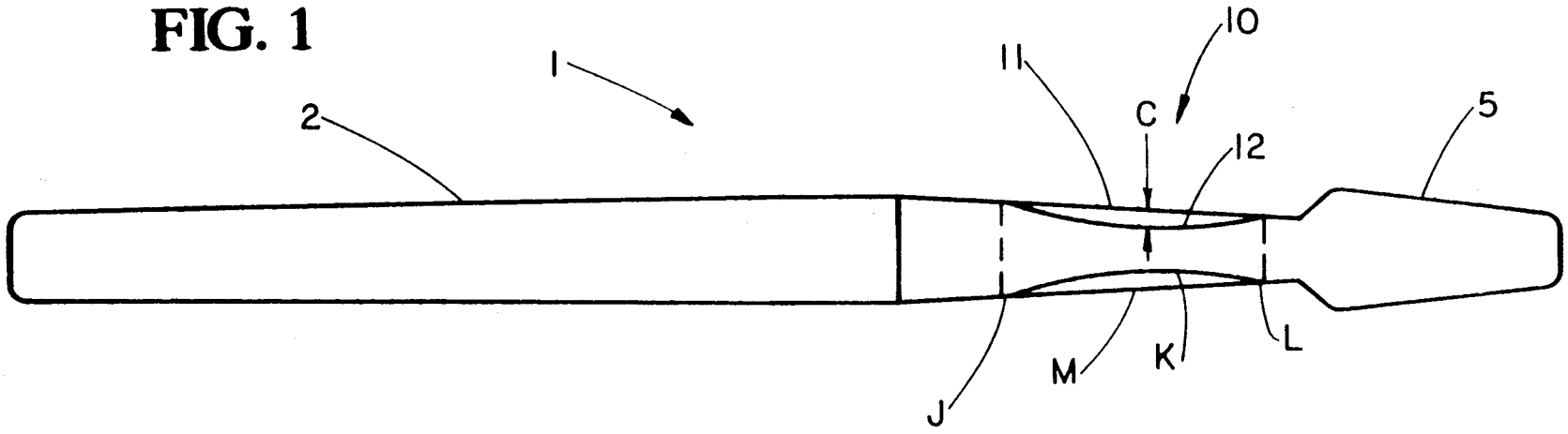
FIG. 1 is a simplified plan view of the back side of a toothbrush of the present invention.

FIG. 1 is a top view of a toothbrush of the present invention, generally denoted by 1. In the embodiment shown in FIG. 1, toothbrush is constructed generally in accordance with the teachings of the aforementioned commonly assigned U.S. patent application Ser. No.

Figure 2:
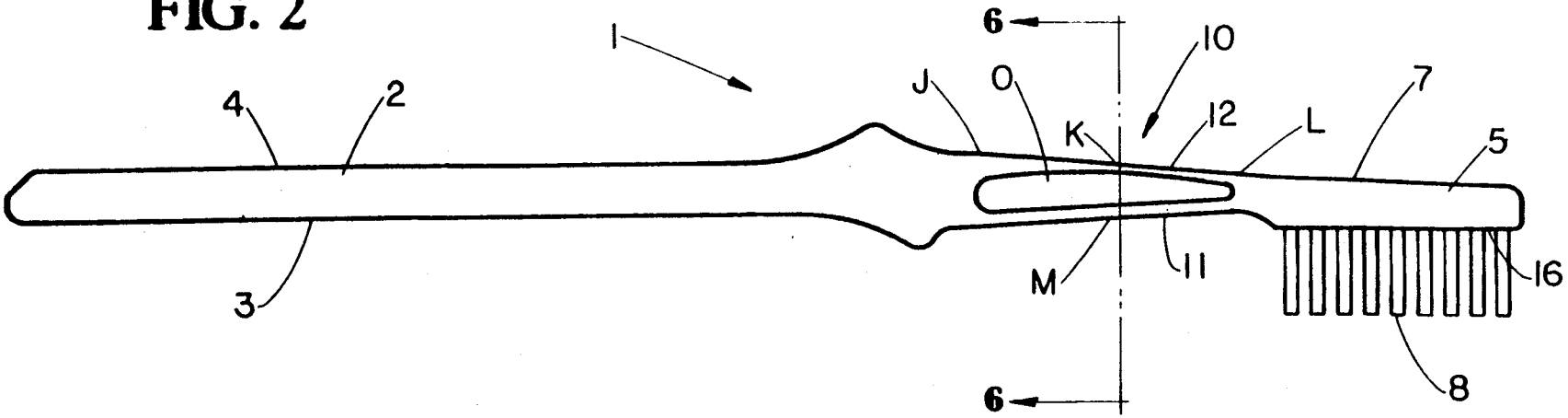
FIG. 2 is a simplified side elevation view of the toothbrush of FIG. 1.

663,214 filed in the name of Robert S. Dirksing, the disclosure of which is incorporated herein by reference. It includes a handle 2, a brush head 5, and a non-pinching twin beam structure 10. Non-pinching twin beam structure 10 is comprised of face side beam 11 and back side beam 12. The handle 2, brush head 5 and non-pinching twin beam structure 10 are preferably integrally molded from a polymeric material. FIG. 2 is a side view of the toothbrush 1 of FIG. 1. Handle 2 includes a face side 3 and a back side 4. Brush head 5 includes face side 16 with attached bristle bundles 8 and back side 7. Face side beam 11 extends between face side 3 of handle 2 and face side 16 of brush head 5. Back side beam 12 extends between back side 4 of handle 2 and back side 7 of brush head 5.

Back side beam 12 includes a taper in cross-sectional width generally symmetric about its length from point "J" to point "K" and from point "L" to point "K". The additional cross-sectional width of face side beam 11 near point "M" relative to the cross-sectional width of back side beam 12 near point "K", noted as dimension "C", serves as a guard which prevents lip and other soft tissue of a user of the toothbrush 1 from entering the gap "0" between the interior surfaces of face side beam 11 and back side beam 12. In a particularly preferred embodiment of the present invention, the width of back side beam 12 at point "K" is about 0.25 in. and the width of face side beam 11 at point "M" is about 0.38 in. Accordingly, in the aforementioned particularly preferred embodiment, dimension "C" is equal to about 0.062 in.

Figure 3:
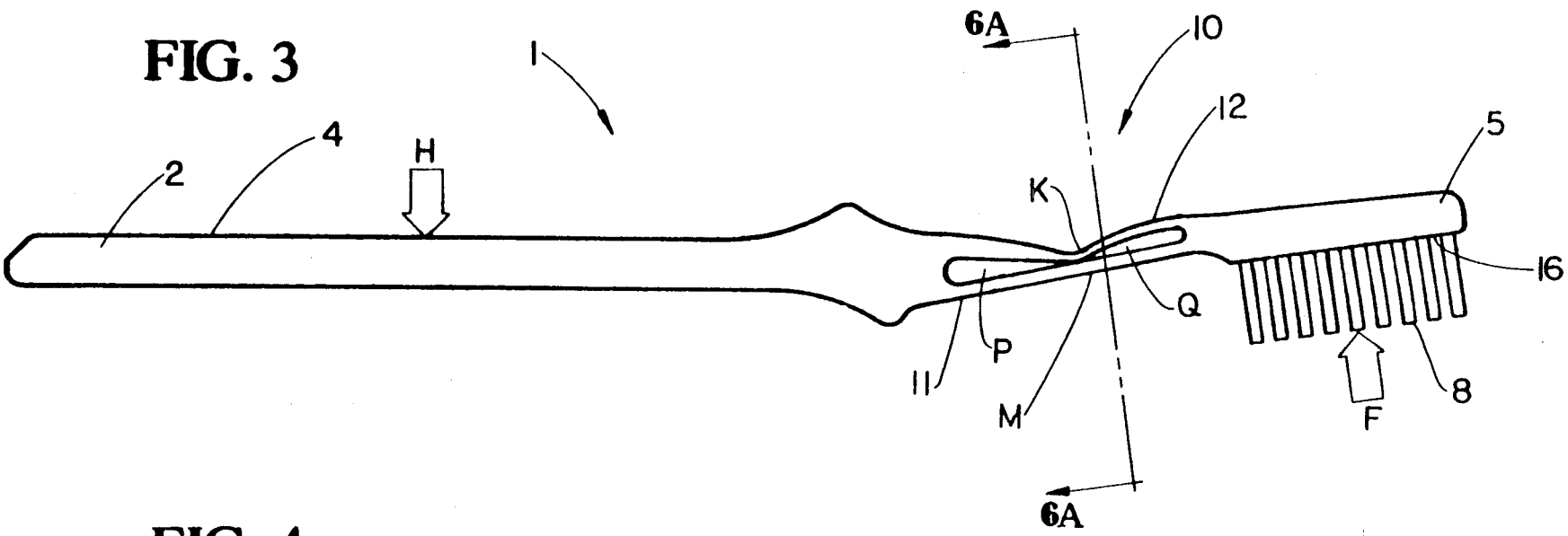
FIG. 3 is a view similar to that of FIG. 2, but showing the toothbrush of FIG. 2 in its buckled condition.

In FIG. 3, toothbrush 1 is shown having been subjected to force "H" applied to the back side 4 of handle 2 resulting in an opposing reactionary force "F" applied to the bristle bundles 8 on the face side 16 of brush head 5. The reaction force "F" is sufficient to produce resilient deformation of non-pinching twin beam structure 10. Back side beam 12 is shown buckled inwardly toward face side beam 11 so that the interior surface of back side beam 12 at point "K" contacts the interior surface of face side beam 11 at point "M". The buckling of back side beam 12 occurs rapidly, especially if the structure is constructed generally in accordance with the teachings of the aforementioned commonly assigned, concurrently filed U.S. Patent Application of Robert S. Dirksing.

If lip or other soft oral tissue were to be caught between back side beam 12 and face beam 11 during the buckling event, rather unpleasant pinching of the toothbrush user's lip or oral tissue will result. However, the greater cross-sectional width of face side beam 11 at point "M" relative to the smaller cross-sectional width of the back side beam 12 at point "K" of the non-pinching twin beam structure 10 of the present invention effectively prevents the user's lip or oral tissue from entering the gap "0", thereby substantially preventing pinching of the user's lip or soft tissue between the interior surfaces of the twin beams, when buckling of back side beam 12 occurs.

Further, when toothbrush 1 is in the buckled condition shown in FIG. 3, two wedge shaped openings "P" and "Q" are formed between the interior surfaces of back side beam 12 and face side beam 11, each wedge shaped opening having its vertex at the point where the interiors of back side beam 12 and face side beam 11 meet, i.e., at the point coinciding with points "K" and "M", respectively.

If toothbrush 1 were stroked in a direction generally parallel to its overall length while in its buckled condition in the process of brushing the user's teeth without the benefit of the non-pinching twin beam structure of the present invention, the wedge shaped openings "P" and "Q" would tend to channel lip and other oral tissue into either the vertex of wedge shaped opening "P" or the vertex of wedge shaped opening "Q", depending upon the direction of the stroke of the toothbrush. This brushing action could also result in an unpleasant pinching of the user's lip or other soft oral tissue, should it enter either opening "P" or opening "Q". However, the greater cross-sectional width of face side beam at point "M" relative to the smaller cross-sectional width of back side beam 12 at point "K" of the non-pinching twin beam structure substantially prevents tissue from entering the wedge shaped openings "P" and "Q", thereby substantially preventing pinching of the user's lips and soft tissue.

Figure 4:
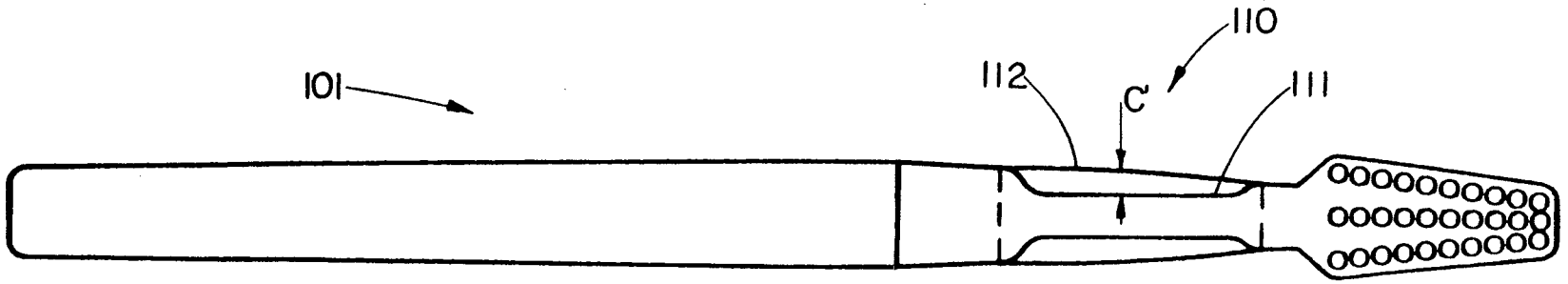
FIG. 4 is a simplified plan view of the face side of another toothbrush of the present invention.

FIG. 4 is a bottom view of another toothbrush 101 of the present invention in which non-pinching twin beam structure 110 comprises face side beam 111 and back side beam 112. Back side 112 includes a slight outward bow in cross-sectional width. Face side beam 111 is shown with a generally symmetric reduced cross-sectional width along a substantial portion of its length relative to back side beam 112. The greater cross-sectional width of back side beam 112 relative to the smaller cross-sectional width of face side beam 111 effectively forms a guard of dimension "C", which prevents lip and other soft oral tissue from being pinched between the interior surfaces of back side beam 112 and face side beam 111 upon buckling of the non-pinching twin beam structure 110.

Figure 6:
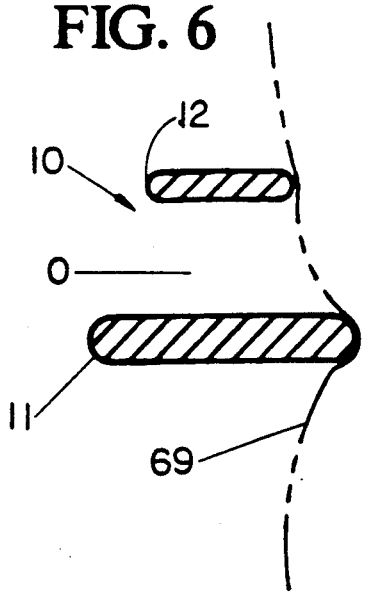
FIG. 6 is a simplified cross-sectional view of a twin beam structure of the present invention taken along section line 6—6 of FIG. 2.
Figure 6A:
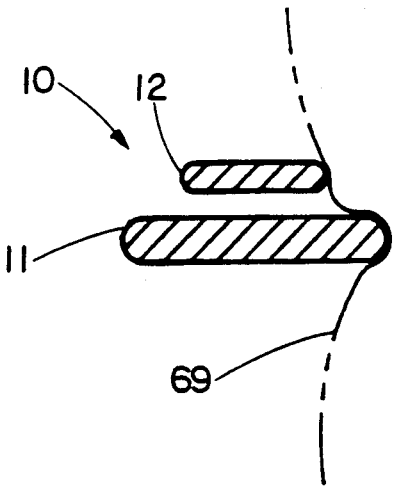
FIG. 6A is a view similar to that of FIG. 6, but showing the twin beam structure of the present invention in its buckled condition.

FIGS. 6 and 6A are cross-sectional views through the non-pinching beam structure 10 of FIGS. 2 and 3, respectively. FIG. 6 illustrates the wider cross-sectional width of face side beam 11 relative to back side beam 12 projecting outwardly to contact soft oral tissue 69, thereby preventing the soft oral tissue 69 from penetrating deeply into the gap "0" between the interior surfaces of face side beam 11 and back side beam 12. During buckling or bending of back side beam 12 toward face side beam 11, soft tissue 69 is deflected by the wider cross-sectional width of face side beam 11 so that back side beam 12 is unable to "bite" soft tissue 69 as it approaches face side beam 11.

FIG. 6A illustrates the arrangement of non-pinching twin beam structure 10 with back side beam 12 in its buckled condition. The normal turgor of the soft oral tissue 69 prevents soft oral tissue 69 from wrapping around the greater outward projection of the wider face side beam 11 and entering into the pinch point between the interior surfaces of back side beam 12 and face side beam 11.

Figure 5:
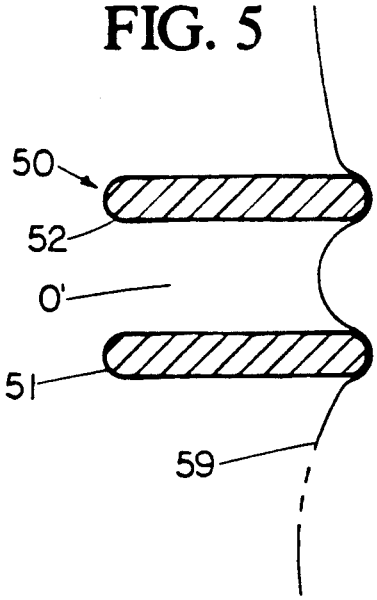
FIG. 5 is a simplified cross-sectional schematic of a toothbrush employing an equal width twin beam structure to connect the brush handle to the brush head, said view being taken prior to buckling of said back side beam.
Figure 5A:
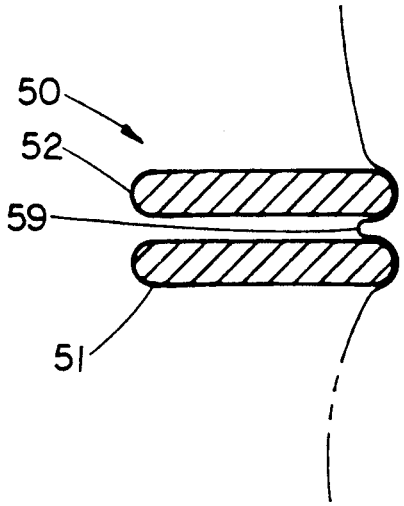
FIG. 5A is a view similar to that of FIG. 5, but showing the equal width twin beam structure in its buckled condition.

FIGS. 5 and 5A are cross-sectional views through a comparable twin beam structure 50 which does not employ the non-pinching twin beam structure of the present invention. FIG. 5 illustrates that both back side beam 52 and face side beam 51 have substantially equal widths and thus press against soft tissue 59 about equally. This permits soft tissue 59 to enter the gap "0'" between the interior surfaces of back side beam 52 and face side beam 51. During buckling or bending of back side beam 52 toward face side beam 51, both back side beam 52 and face side beam 51 "bite" about equally against the user's soft tissue 59. This substantially equal "bite" causes soft tissue 59 to become trapped between the generally equal cross-sectional width of back side beam 52 and face side beam 51. FIG. 5A illustrates the condition of twin beam structure 50 in its buckled state. Soft oral tissue 59 is pinched between the interior surfaces of back side beam 52 and face side beam 51. Unlike the non-pinching twin beam structure 10 shown in FIGS. 6 and 6A. the relatively equal cross-sectional widths of back side beam 52 and face side beam 51 do not permit one of the beams to act as a guard to prevent soft oral tissue 59 from entering the opening formed between the interior surfaces of back side beam 52 and face side beam 51.

While particular embodiments of the present invention have been illustrated and described, it will be obvious to those skilled in the art that various changes and modifications can be made without departing from the spirit and scope of the present invention. It is intended to cover, in the appended claims, all such modifications that are within the scope of this invention.

What is claimed is:

1. A toothbrush comprising a handle having a face side and a back side opposite said face side, a brush head having a face side which carries bristles for cleaning the user's teeth and gums and a back side opposite said face side, said toothbrush further including a non-pinching resilient twin beam structure which is capable of undergoing flexure whenever a sufficient force is applied to said brush head in use, said non-pinching resilient twin beam structure having a first end connected to said brush handle and a second end connected to said brush head, said non-pinching resilient twin beam structure comprising a face side beam extending between and connected to said face side of said handle and said face side of said brush head and a back side beam extending between and connected to said back side of said handle and said back side of said brush head, said face side beam and said back side beam having opposed interior surfaces which form a gap between said beams that decreases in size whenever said twin beam structure undergoes flexure, one of said face side beam and said back side beam being wider in cross-section than the other of said beams along at least a portion of its length, to substantially prevent the entry of soft oral tissue into said gap formed between said interior surfaces of said face side beam and said back side beam when said toothbrush is in use, thereby substantially prevent pinching of said soft oral tissue between said interior surface of said face side and back side beam as the gap between said interior surfaces of said beams decreases during flexure of said non-pinching twin beam structure.

2. A toothbrush having the non-pinching twin beam structure of claim 1, wherein said face side beam is wider in cross-section than said back side beam.

3. A toothbrush having the non-pinching twin beam structure of claim 2, wherein said back side beam tapers in cross-sectional width from each of its end points to a point of minimum cross-sectional width located approximately midway between said brush handle and said brush head, the corresponding point on said face side beam exhibiting a greater cross-sectional width than said point of minimum cross-sectional width on said back side beam.

4. A toothbrush having the non-pinching twin beam structure of claim 1, wherein said face side beam tapers in cross-sectional width from each of its end points to a point of minimum cross-sectional width located approximately midway between said brush handle and said brush head, the corresponding point on said back side beam exhibiting a greater cross-sectional width than said point of minimum cross-sectional width on said face side beam.

5. A toothbrush having the non-pinching twin beam structure of claim 1. wherein one of said face side beam and said back side beam is wider in cross-section than the other of said beams along substantially all of its length.

6. The toothbrush of claim 1, wherein said twin beam structure will substantially resist deflection of said brush head relative to said brush handle until a predetermined brushing force is exceeded by the user.

7. The toothbrush of claim 1, wherein said twin beam structure will permit said brush head to immediately deflect relative to said brush handle in direct proportion to the applied brushing force.

8. The toothbrush of claim 1, wherein said brush handle, said brush head and said twin beam structure are integrally molded from a polymeric material.

* * * * *

UNITED STATES PATENT AND TRADEMARK OFFICE

CERTIFICATE OF CORRECTION

PATENT NO. : 5,105,499

DATED : April 21, 1992

INVENTOR(S) : Robert S. Dirksing

It is certified that error appears in the above-identified patent and that said Letters Patent is hereby corrected as shown below:

Column 2, line 24, "on a" should read -- one -- .

Column 2, line 66, after "toothbrush" insert -- 1 -- .

Column 6, line 1, "prevent" should read -- preventing -- .

Signed and Sealed this

Twenty-ninth Day of June, 1993

*Attest:*

Michael K. Kirk

MICHAEL K. KIRK

*Attesting Officer*

*Acting Commissioner of Patents and Trademarks*